US009687907B2

(12) United States Patent
Gaebges et al.

(10) Patent No.: US 9,687,907 B2
(45) Date of Patent: Jun. 27, 2017

(54) CASTING DEVICE WITH AN ANNULAR DUCT AND A CASTING METHOD

(71) Applicant: SCHULER PRESSEN GMBH, Goeppingen (DE)

(72) Inventors: Martin Gaebges, Albershausen (DE); Juergen Fahrenbach, Aichelberg (DE); Tobias Schwarz, Varel (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 60 days.

(21) Appl. No.: 14/280,681

(22) Filed: May 19, 2014

(65) Prior Publication Data

US 2014/0345825 A1 Nov. 27, 2014

(30) Foreign Application Priority Data

May 27, 2013 (DE) ..... 10 2013 105 433

(51) Int. Cl.

| | |
|---|---|
| ***B22C 9/08*** | (2006.01) |
| ***B22D 17/30*** | (2006.01) |
| ***B22D 17/20*** | (2006.01) |
| ***B22D 17/22*** | (2006.01) |

(52) U.S. Cl.

CPC ..... *B22C 9/08* (2013.01); *B22D 17/2023* (2013.01); *B22D 17/22* (2013.01); *B22D 17/30* (2013.01)

(58) Field of Classification Search

CPC .. B22C 9/08; B22D 17/2015; B22D 17/2023; B22D 17/2069; B22D 17/2076; B22D 17/22; B22D 17/30; B22D 17/20; B22D 27/11

USPC ..... 164/271, 284, 303, 304, 305, 306, 319, 164/320, 321, 120

See application file for complete search history.

(56) References Cited

U.S. PATENT DOCUMENTS

| | | | | |
|---|---|---|---|---|
| 4,243,093 | A * | 1/1981 | Nieman | B22D 19/00 164/112 |
| 6,997,231 | B1 * | 2/2006 | Jung et al. | B22D 17/14 164/113 |
| 2002/0056537 | A1 | 5/2002 | Fink | |
| 2003/0041995 | A1 | 3/2003 | Nagasaka et al. | |
| 2009/0014144 | A1 | 1/2009 | Kotagiri et al. | |
| 2013/0233507 | A1 | 9/2013 | Müller | |
| 2014/0238633 | A1 | 8/2014 | Schwarz | |
| 2014/0345824 | A1 | 11/2014 | Fahrenbach et al. | |

FOREIGN PATENT DOCUMENTS

| | | |
|---|---|---|
| DE | 1 290 672 B | 3/1969 |
| DE | 196 06 806 A1 | 8/1997 |
| DE | 10 2008 052 062 A1 | 4/2010 |
| DE | 10 2011 050 149 A1 | 5/2012 |
| DE | 10 2013 101 962 B3 | 5/2014 |
| DE | 10 2013 105 435 B3 | 7/2014 |
| EP | 1 201 335 A1 | 5/2002 |
| WO | WO 2006/122423 A1 | 11/2006 |

* cited by examiner

*Primary Examiner* — Kevin P Kerns
(74) *Attorney, Agent, or Firm* — Norman B. Thot

(57) ABSTRACT

A casting device includes a mold cavity configured to form a hollow space for a cast part, a casting chamber for a metal melt, a gating system, an annular duct for the metal melt, and at least two annular duct connections configured to connect the casting chamber to the annular duct. The annular duct is configured to be connectable with the mold cavity via the gating system.

15 Claims, 2 Drawing Sheets

CASTING DEVICE WITH AN ANNULAR DUCT AND A CASTING METHOD

CROSS REFERENCE TO PRIOR APPLICATIONS

Priority is claimed to German Patent Application No. DE 10 2013 105 433.1, filed May 27, 2013. The entire disclosure of said application is incorporated by reference herein.

FIELD

The present invention relates to a casting device with a mold cavity forming a hollow space for a cast part, a casting chamber for a metal melt, and a gating system. The present invention further relates to a casting method for manufacturing cast parts with this casting device.

BACKGROUND

Melts destined for casting, more specifically, metal melts, give off much heat into their environment. In order to achieve good casting quality, an excessive cool-down during the casting process must be avoided. The casting in cold chamber die casting methods therefore takes place at a high speed and under a high pressure. Depending on the size of the cast part and its minimal wall thickness, the mold filling process of the die cast mold forming the mold cavity typically lasts a few milliseconds.

Each type of melt has certain suitable gate velocities and gating systems. Since a maximal gate velocity must not be exceeded, the cross-section of the gate surface and thus the part of the gating system that allows for separation of the sprue part from the die casting mold after the casting process must have sufficiently large dimensions. For planar and thin-walled cast parts, this requirement leads to a great proportion of circulating material, the mass of which can lie in the range of the mass of the cast part itself. The circulating material is subsequently melted again, which requires a considerable supply of external energy.

It is additionally necessary to provide that the melt does not solidify anywhere in the system through which the melt passes during the entire filling process. This can be provided by sufficiently large cross-sections of the gate channels. Large gate channels, however, lead to an increase of the casting mass so that a greater part of the melt is lost. As a rule, large cast parts with several gate areas or particularly thin-walled cast parts therefore require several gate channels as runners in order to avoid solidification in the mold cavity before it is completely filled.

In order to reduce the amount of circulating material, EP 1 201 335 B1 describes a hot chamber die casting method with a fan or tangential gate as a gating system. This gating system can uniformly fill the mold cavity, but leads to a complex structure of the casting device and requires an individual heating of the plurality of runners, more specifically, when using multi-cavity molds. The thin-walled runners are continuously heated during the cool-down of the cast part, which requires a considerable supply of energy, particularly for a gating systems with many branches required for large-scale parts.

SUMMARY

An aspect of the present invention is to improve the prior art and, more specifically, to provide a casting device for a die casting method that avoids the aforementioned disadvantages. Another aspect of the present invention is to develop a casting method for metal melts which minimizes the proportion of circulating material even for thin-walled and large-scale parts and which at the same time minimizes the energy required to maintain the melt in a liquid state, while abiding with the maximum gate velocity.

In an embodiment, the present invention provides a casting device which includes a mold cavity configured to form a hollow space for a cast part, a casting chamber for a metal melt, a gating system, an annular duct for the metal melt, and at least two annular duct connections configured to connect the casting chamber to the annular duct. The annular duct is configured to be connectable with the mold cavity via the gating system.

BRIEF DESCRIPTION OF THE DRAWINGS

The present invention is described in greater detail below on the basis of embodiments and of the drawings in which.

DETAILED DESCRIPTION

Figure 1:
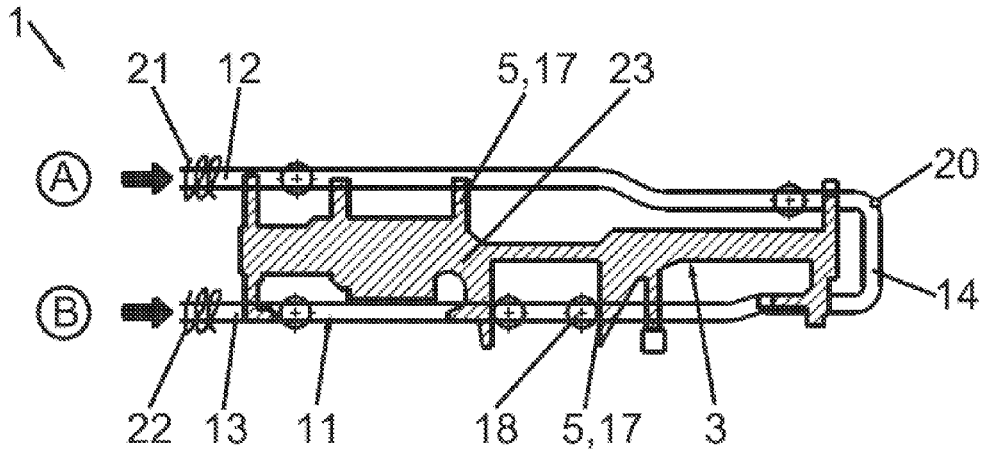
FIG. 1 shows a first part of a casting device according to the present invention with an annular duct for the melt and a mold cavity in a longitudinal section.
Figure 2:
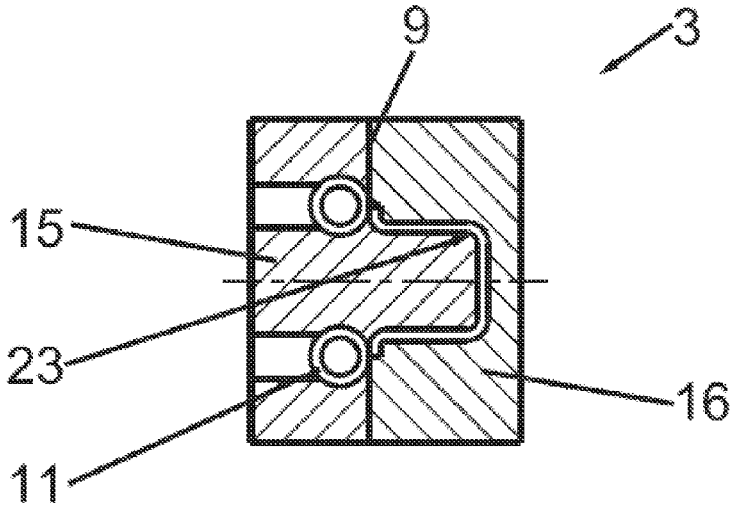
FIG. 2 shows a cross-section through the first part of the casting device shown in FIG. 1, viewed in the direction of the annular duct connections.

The annular duct guides the metal melt up to the immediate vicinity of the cast part so that the gating system itself, which is formed by relatively thin gate channels branching off from the annular duct toward the cast part, requires only small cross-sections and short gate channels. As a rule, the annular duct is, therefore, considerably longer than the length of the gate channels; its length will frequently exceed the sum of the lengths of the gate channels. The proportion of material that possibly solidifies or at least cools down together with the cast part in the gate channels is thus reduced to a minimum. The cooling power required in the tool before demolding is thereby considerably reduced. In particular, less released melt energy needs to be discharged.

Since the annular duct passes in a spatially close proximity to the mold cavity, the gate channels can be very short and relatively many gate channels can branch off the annular duct, so that a more uniform filling of the form is possible.

In many cases, a heating of the gate channels is not necessary when the runners of the gating system in the form of the gate channels are kept very short. This allows for a more cost-effective, more finely branched gating system, with more gate channels, which in turn has a positive impact on mold filling without having to increase the centrally applied casting pressure.

Several annular ducts having their own respective annular duct connections can be provided, for example, for large thin-walled cast parts or cast parts that have a complex spatial structure. As an alternative for double or multiple annular ducts, annular duct branches with potentially differing diameters can also be provided which are led back into the main line before recirculation of the melt, or have their own annular duct connection. In the latter case, the number of melt discharging annular duct connections no longer corresponds to the number of melt supplying annular duct connections. The present invention is hereafter further described based on the example of an annular duct.

In an embodiment of the casting device, all or part of the gate channels have casting valves. After the casting process, the casting valves separate the liquid melt of the annular duct from the melt on the side of the cast part, which solidifies together with the cast part. In order to again fill the mold for the next cast part, the casting valve or the casting valves are again opened.

In the proposed casting device, the gate areas are formed in the immediate vicinity of the cast part so that the mass of the sprue system is smaller than the mass of the cast part. Sprue masses of less than 20% of the mass of the cast part are thereby achievable even with large-scale structural parts. The gating system can at the same time be compact. The sprue material can be reused as circulating material. Due to the fact that less sprue material needs to be melted, and that the hot melt is always available in the annular duct close to the mold cavity, the casting cycle takes less time, so that the cycle time is improved.

The annular duct can have a relatively large diameter compared to the gate channels so that heat conduction losses and thermal radiation losses of the melt transported through them can be minimized. By means of a circulation according to the present invention within the annular duct during casting or at least in the phase in which the cast part cools down, a cool-down of the melt can additionally be reduced.

With a suitable setting, the circulation can suffice as a sole measure for preventing a solidification of the melt before one cycle in the annular duct has been completed. The melt then reaches the casting chamber or another hot cell in a still liquid state. An external heating of the annular duct can in some cases thus be dispensed with.

In an embodiment of the present invention, the annular duct is heatable at least in sections. It is thus provided that a solidification of the used melt is reliably prevented even in relatively long annular ducts, and that the melt is sufficiently fluid for it to promptly reach even remote gate channels.

During the second casting phase, the annular duct is filled with the metal melt and pressurized. Between the individual casting phases, the melt can circulate in the annular duct in order to be led back into a basin, such as the casting chamber, that is as compact as possible, where it is heated up again. The annular duct therefore has two annular duct connections that are connected to the same casting chamber. Instead of, or in addition to, the casting chamber, another hot cell can also be provided for supply of the melt or for intermediate storage of the melt.

It is also feasible that the two connections of the annular duct flow into different hot cells, the hot cells being adapted to be pressurized together at least during casting, i.e., to form a common system of communicating cells.

In an embodiment, the annular duct is filled with melt only because of the casting pressure. Additional mechanisms, such as pumping means, are alternatively provided which lead the melt into the annular duct or which can accelerate the flow of the melt in the annular duct. The pumping means can be freely disposed on or around the annular duct. The pumping means can, for example, be disposed at the annular duct connections, and therefore at the end in the transition area to the casting chamber. Several pumping means can be disposed in spatial separation and be connected in series in order to increase pumping capacity.

In the case of metal melts, the pumping means can be designed as coils. The electromagnetic alternating fields that are producible by the coils induce eddy currents in the electrically conductive melt and can therefore act on the melt without contact. According to the principle of linear motors, an electromagnetic travelling field can be achieved by means of the inductor. The melt forms the rotor of the linear motor. The magnetic field exerts forces on the eddy currents, the strength of which depends on the spatial variation of the magnetic flux density. The melt thus experiences a force aligned on the lesser magnetic flux density. The melt current is accelerated analogous to a Lorentz force acting on a solid body, displacing it in space.

In order for the dimensions of the coils to not become too large, field shapers can be used that concentrate the action of the force on one specific area. A field shaper can, for example, be designed as a conductor which is cut in the longitudinal direction of the coil axis and is charged with short current pulses. Due to the skin effect, the short impulses barely penetrate the conductor itself and can thus act on the densely flowing melt with very high field strength.

The pumping means can, for example, be controlled or adjusted independently from each other and can ideally convey the melt into the annular duct and out of the annular duct. It can be thus achieved, for example, that the melt flow temporarily takes place out of both annular duct connections via the annular duct into the mold cavity. Due to the efficiency losses in the operation of the pumping means, the pumping means additionally heat the melt, which constitutes a welcome side effect to prevent premature cooling of the melt. In another mode of operation, the pumping means merely heat the melt.

In an embodiment, the pumping means can also convey the melt into the annular duct without the external pressure of a plunger. The first filling or re-filling of the annular duct after a mold change can thus, however, be accelerated and facilitated via a specific cooperation with an external pressure. If the annular duct has additional heating means, it can be advantageous to heat up the annular duct before the first filling.

In order to be able to quickly fill the annular duct, the duct can have one or several air release valves. The gas, protective gas, or gas mixture that is first present in the annular duct can escape through the air release valves. The gas escaping through the air release valves can be guided in a collecting duct, which can also run close to the cast part and be shaped as an annular duct.

The pumping means can also be provided in order to actively empty the annular duct as quickly as possible, similarly to the filling process. The melt then flows into the lower hot cell not only due to gravity but also with the active support of the pumping means. It can be convenient to switch the pumping direction in order to shorten the emptying time, but it is not absolutely necessary, since maintaining circulation while closing the intake is sufficient. Pumping means that do not allow for an inversion of the direction can also be used in that case.

Emptying the melt into the hot cell makes it easier to maintain the temperature of the melt because, in a compact collecting vessel, it can have a more advantageous surface area to volume ratio. The annular duct can be undocked after emptying.

The casting device comprises a casting chamber which is fillable from a melt reservoir. The casting chamber can be oriented horizontally and is capable of being pressurized by a horizontally displaced plunger. In an embodiment, the casting chamber can, for example, be fillable from below and be separable from the melt reservoir by way of a melt valve. The casting chamber can also be oriented vertically; in that case, the melt valve can, for example, be disposed laterally and the plunger can, for example, be displaced into the casting chamber from below.

The casting chamber has two annular duct connections A and B serving as outlets of the annular duct. The annular duct connections are end points of two connecting ducts, which are connected to each other at their ends facing away from the casting chamber. The entire annular duct including the annular duct connections are designed to be pressure-resistant.

The annular duct connections can, for example, flow into the casting chamber at different heights so that, during the first filling of the annular duct, a venting takes place only through the upper annular duct connection.

In an embodiment of the present invention, both annular duct connections can, for example, be disposed on the same front side of the casting chamber. This allows for the length of the annular duct to be designed to be as short as possible, to avoid diverters, and thus minimize flow resistance.

The casting chamber with the annular duct connections can, for example, form the lowest point of the pressurized system so that, in the absence of an externally acting pressure, the melt tends to flow back into the casting chamber. An annular duct having a continuous slope in the direction of the casting chamber is suited therefor. In an embodiment, the annular duct connections can, for example, be configured so that a complete emptying of the annular duct can take place. The annular duct is thereby arranged immediately after the annular duct connections so that it always runs above the level of the casting chamber.

The annular duct has one or several coupling connections for the gate channels which connect the annular duct to the mold cavity. The coupling connections are also designed to be pressure-resistant. The operation mode of the casting device according to the present invention is further described in connection with the proposed casting method.

In an embodiment, the present invention provides a casting method using the aforementioned casting device, wherein the melt circulates in the annular duct during casting or between the casting processes. Circulation refers to the fact that the melt is not only displaced locally within the annular duct, but also that a mass feed of the melt occurs.

In order to provide circulation, the annular duct can, for example, be provided with a pumping means as described above. It can also be exposed at least partially to external heat sources in order to avoid premature surface layer solidification and to provide a constantly low viscosity during melt circulation.

During the different casting phases, the pumping means can, for example, operate as follows: first, a rapid first filling of the annular duct occurs. To this end, both pumping means convey the melt out of the casting chamber into the annular duct with the highest possible output. In order to speed up the casting process as a whole, a melt valve, which is disposed between the casting chamber and a melt reservoir, is opened, so that enough melt can flow in. Subsequent refilling of the amount of melt taken for the respective cast part can occur by way of the same melt valve.

After filling the annular duct, one of the pumping means can convey the melt into the annular duct and the other pumping means can convey the melt out of the annular duct. One of the pumping means can, for example, convey the melt with a greater output into the annular duct than the other pumping means. The pumping means of the second connecting duct also conveys into the annular duct in order to avoid a stall in the melt flow. Due to the differential pressure thus built up, the melt begins to circulate within the annular duct. The greater the power difference with which the pumping means are operated, the faster the circulation. In order to optimally use this effect, the connecting duct A can also be provided with a more powerful pumping means, i.e., a pumping means that has a higher maximum output or that comprises a greater number of pumping means than connecting duct B. If the connected loads of the pumping means are the same, the pumping means at connecting duct A can, for example, be operated at 100% of its power output, whereas the pumping means at connecting duct B operates at a maximum of 50% of its connected load.

In case two connecting ducts end at different heights, the pumping means of the upper connecting duct A can, for example, operate with a higher output than that of the lower connecting duct B.

The circulation includes the entire casting system involved in the casting process consisting of the annular duct and the casting chamber, which is pressurized by means of a plunger, in order to generate the required pressure. In addition to or instead of the casting chamber, a hot cell can be disposed in the casting system which is involved in the circulation. The circulation can advantageously cause a uniform heat distribution in the melt so that solidification can be reliably prevented even in long annular ducts and during long intermediate phases. The melt that cools down in the annular duct and flows back into the casting chamber can be heated up again therein by way of a hot cell or by means of an external heat supply.

At the beginning of the second casting phase, the melt valve is closed and the casting chamber and the connected annular duct are pressurized by an advancing plunger. The force that needs to be applied for displacing the plunger can, for example, be generated by a hydraulic drive unit that is connected to the plunger by way of a coupling.

During the second casting phase, the mold cavity is filled with the melt via opened casting valves. The amount of melt provided for filling is pushed in by the advancing plunger, wherein it is provided that the plunger does not pass over the melt valve. A minimum amount of melt thereby always remains in the casting chamber so that the circulation of the melt can be maintained at any point in time, more specifically, after the end of the second casting phase. It can also be provided that during filling of the mold, the melt flow into the annular duct temporarily takes place through several or all annular duct connections.

The melt used up by the casting process can be refilled before the next casting process by opening the melt valve again and retracting the plunger.

The annular duct can be emptied very quickly after completion of the cast production. In order to empty the annular duct, it is provided that the pumping means of all the annular duct connections can convey the melt out of the annular duct first into the casting chamber and into the melt reservoir via the opened melt valve. The connecting ducts are disposed so that the melt cannot flow out of the melt reservoir on its own. The annular duct can therefore be safely undocked in the emptied state. For safety reasons, it is nevertheless recommended to close the melt valve before undocking.

While the method and the casting device have been described with respect to die casting, the method can also be applied to other casting methods. In principle, non-metallic melts can also be cast into suited casting devices instead of metal melts.

The casting device according to the present invention and the method of operation according to the present invention for operating the casting device are hereafter described in more detail under reference to the drawings.

Figure 3:
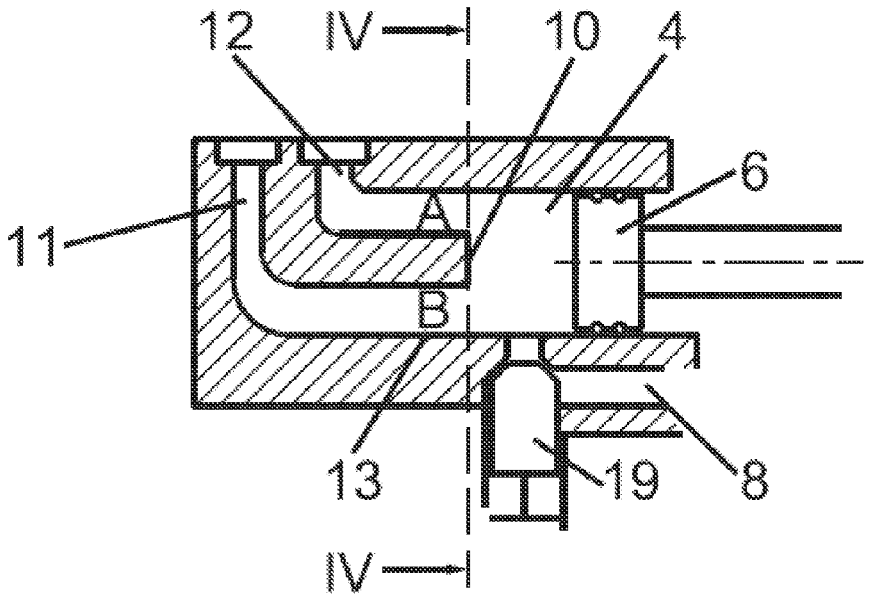
FIG. 3 shows a longitudinal section of a second part of the casting device with the casting chamber and two annular duct connections.
Figure 4:
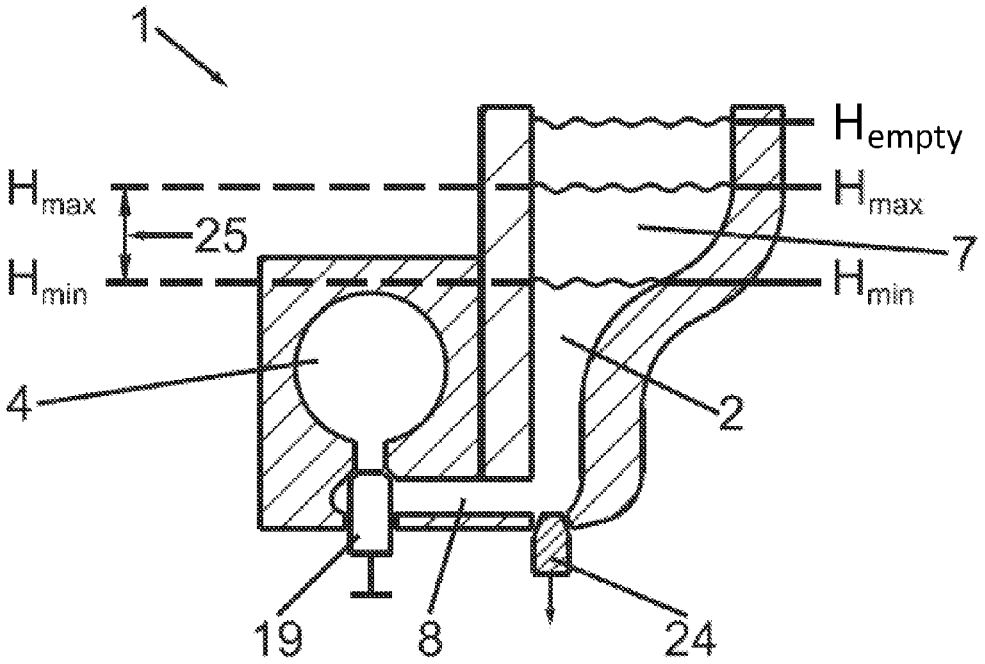
FIG. 4 shows a cross-section of the second part of the casting device shown in FIG. 3 with the melt reservoir.

FIG. 4 shows a part of a casting device 1 for die casting metal melts such as magnesium or aluminum melts. The melt 2 is led out of a melt reservoir 7 into a casting chamber 4 via a supply duct 8 that is capable of being shut off by means of a melt valve 19. The casting chamber 4 is oriented horizontally and is capable of being pressurized by a hydraulically displaced, horizontally advancing plunger 6 (FIG. 3). At its front side 10 facing the plunger 6, the casting chamber 4 has exactly two annular duct connections A and B, which form the ends of an annular duct 11.

As shown in FIG. 1, the annular duct 11 passes close to the mold cavity 3 and is formed by two pressure-resistant connecting ducts 12, 13 running substantially parallel to each other. The connecting ducts 12, 13 flow into the casting chamber 4 through annular duct connections A and B, the annular duct connection A being disposed above the annular duct connection B. At their ends 14 facing away from the casting chamber 4, the connecting ducts 12, 13 are connected to each other. In order to reduce flow resistance, the connecting ducts 12, 13 are designed as substantially straight pipes and their far ends 14 have a U-shaped profile in a longitudinal section.

Pumping means 21, 22 in the form of coils are disposed at the ends of the annular duct connections A and B, which can be respectively operated in three different manners. In the first "forward" mode of operation, a pumping means 21, 22 conveys the metal melt 2 into the annular duct 11, in the second "backward" mode of operation, it counteracts an entry of the melt 2 or conveys it out of the annular duct 11, and in the third mode of operation, it heats up the melt 2 and does not implement a conveying effect.

The melt 2 can leave the casting chamber 4 via both connecting ducts 12, 13 and flow into the mold cavity 3 via several gate channels 17 forming a gating system 5, which are capable of being shut off via casting valves 18. The mold cavity 3 itself is formed by two casting mold half shells 15, 16 and is formed in a known manner by the negative form of the die cast part 23 to be formed increased in size by the shrinkage value. Both casting mold half shells 15, 16 have a separation surface 9 for subsequent removal of the cast part 23. Since the gate channels 17 are only connected to the mold cavity 3 and the annular duct 11 and not directly with the casting chamber 4, the melt 2 must first be conveyed into the annular duct 11 in order to get into the mold cavity 3.

The mold cavity 3 has a thin-walled, planar and complex structure as well as areas with considerably varying diameters. Several gate channels 17 are disposed in different cast part specific positions of the annular duct 11 for a rapid and uniform filling. Depending on the structure of the mold cavity 3, the individual gate channels 17 have different lengths and different diameters that are adjusted to each other so that an optimal filling process of the mold cavity 3 is achieved.

The operation of the casting device shown in FIG. 1 to FIG. 4 is divided into six different phases. In the first phase, the initial position, the hot cell configured as a casting chamber 4 is empty and pre-heated. The melt valve 19 and the drain plug 24, by way of which the supply duct 8 can be emptied, are closed. Depending on the melt type, the casting device 1 is operated with a protective gas. The melt reservoir 7 is filled by means of a dosing ladle or a dosing furnace (not shown) with an amount of melt that corresponds to a melt level $H_{empty}$ in the melt reservoir 7. The melt level $H_{empty}$ is measured so that the melt volume in the melt reservoir 7 with the connected supply duct 8 corresponds at least to the volume of the melt carrying system consisting of the casting chamber 4, the annular duct 11, the gating system 5 and the volume of a cast part 23 plus the cast batch amount. The cast batch amount corresponds to the volume of the desired number of cast parts, i.e., at least one, that is required in order for the melt level $H_{min}$ in the melt reservoir 7 to still be above the casting chamber 4, without additional melt 2 being supplied to the melt reservoir 7. The casting chamber 4 can thus be filled merely by the hydrostatic pressure of the melt 2 in the melt reservoir 7.

By opening the melt valve 19, gravity causes the casting chamber 4 to be filled with the melt 2. Venting of the casting chamber 4 can occur by way of the upper annular channel A, which has an air release valve 20 that can be opened at that point in time. When the melt valve 19 is opened, the pumping means 21, 22 are operated in the "backward" operation mode, so that an overflow of the melt 2 at the annular duct connections A and B into the connecting ducts 12, 13 is not possible despite the continuously rising melt level in the melt reservoir 7. Once the initial fill-up of the casting chamber 4 has been completed, the melt level has sunk to the level $H_{max}$. This phase of initial filling ends with the melt valve 19 being shut off.

In the second phase following the first phase, the annular duct 11 is filled. The annular duct 11 is vented via the air release valve 20 until it has been evacuated. In doing so, the casting valves 18 are closed. After venting, the air release valve 20 is closed and the melt valve 19 is opened, the pumping means 21, 22 being simultaneously switched into the "forward" direction. The annular duct 11 is thus rapidly filled under a pressure of up to 5 bar with the melt 2 from the melt reservoir 7. As soon as the annular duct 11 is completely filled up, the pumping means 22 of the annular duct connection B switches to a "forward" output of approximately 20%, while the pumping means 21 at the annular duct connection A still operates with a "forward" output of 100%. Due to the differential pressure thus built up, the melt 2 begins to circulate in the annular duct 11 and to continuously rotate in the annular duct 11 with the connected casting chamber 4. Emptying the annular duct 11 is impossible in this state. Once this second phase has ended, the casting device is prepared for the mold filling process (third phase).

In the third phase, the melt valve 19 is closed and the casting chamber 4 is thus separated from the melt reservoir 7. A pressure can thus be built up by the casting drive unit and be introduced into the casting chamber 4 and the annular duct 11 by way of the plunger 6. The casting takes place by opening the casting valves 18, the required amount of melt being pushed in by the plunger 6. Due to the fact that the melt 2 flows into the mold cavity 3, the melt 2 flows not only through the annular duct connection A but also through the annular duct connection B. In order to counteract excessively high flow speeds in the annular duct 11, the pumping means 22 of the annular duct connection B can be temporarily operated with a higher "forward" output during the mold fill time, but still with a lesser output than the pumping means 21 at the annular duct connection A, so that the circulating mode and thus the circulation is maintained. Once the mold filling process has been completed, the casting valves 18 are closed and the cast part 23 can cool down.

During solidification of the cast part 23, the casting chamber 4 is prepared for a new mold filling process. In this fourth phase, the plunger 6 travels into its initial position, whereby the melt valve 19 is opened. The melt 2 is thereby sucked out of the melt reservoir 7, which is supported by the hydrostatic pressure of the melt column in the melt reservoir 7. During this period of reloading the casting chamber 4, the annular duct 11 remains in the circulating mode. Once the casting chamber 4 is completely filled up, another mold filling process can take place with a new mold cavity 3.

An exact dosage of the melt amount is not only required in order to completely fill the mold cavity 3 on the one hand and on the other hand to avoid bursting of the remaining material thus formed, but also in order to always keep the minimal melt level $H_{min}$ above the casting chamber 4 so that it is always completely fillable. During phases three and four, the melt level in the melt reservoir is thus always maintained between $H_{min}$ and $H_{max}$. The height difference between $H_{min}$ and $H_{max}$, which is represented by the arrow 25, corresponds to the possible removal volume for one or several cast parts 23. Depending on the casting device 1, refilling the melt reservoir 7 can take place in the third phase, in the subsequent fourth phase or only after the fifth phase.

If no additional cast parts 23 are to be manufactured after completion of all the mold filling processes, the annular duct 11 is emptied as a fifth phase. To this end, both pumping means 21, 22 are operated in the "backward" direction with closed casting valves 18 and the melt valve 19 is opened, so that the melt 2 is pumped by the pumping means 21, 22 into the supply duct 8 leading to the melt reservoir 7. Once the annular duct 11 is emptied, it is separated from the melt reservoir 7 by closing the melt valve 19 and can be uncoupled from the mold cavity 3 and moved out of the press.

In the sixth phase, which requires completion of the fifth phase, the casting chamber 4 is also emptied of the melt 2, so that no melt 2 remains in the hot cell of the casting device 1. To this end, the melt reservoir 7 is emptied by way of a drain plug 24. Once the melt reservoir 7 has been emptied, or while being emptied, the melt valve 19 is opened so that the melt 2 can also flow out of the casting chamber 4 into a crucible (not shown) by way of the supply duct 8 and the drain plug 24.

The present invention is not limited to embodiments described herein; reference should be had to the appended claims.

LIST OF REFERENCE NUMBERS

1 casting device
2 melt
3 mold cavity
4 casting chamber
5 gating unit
6 plunger
7 melt reservoir
8 supply duct
9 separation surface
10 front side of the casting chamber
11 annular duct
12 (upper) connecting duct
13 (lower) connection duct
14 end
15 casting mold half shell
16 casting mold half shell
17 gate channel
18 casting valve
19 melt valve
20 air release valve
21 pumping means
22 pumping means
23 cast part
24 drain plug
25 arrow
A upper annular duct connection
B lower annular duct connection
$H_{min}$ minimum melt level
$H_{max}$ maximum melt level
$H_{empty}$ melt level with an empty annular duct

What is claimed is:

1. A refillable casting device comprising:
a mold cavity configured to form a hollow space for a cast part;
a casting chamber for a metal melt;
a plunger configured to pressurize the casting chamber;
a gating system; and
a circulation duct for the metal melt, the circulation duct comprising,
a first connecting duct,
a second connecting duct, and
at least two circulation duct connections configured to connect the casting chamber to the first connecting duct and to the second connecting duct,
wherein,
the first connecting duct and the second connecting duct are connected to each other in an area of the casting device which faces away from the casting chamber, and
the circulation duct is configured to be connectable with the mold cavity via the gating system and to circumscribe the mold cavity.

2. The casting device as recited in 1, wherein the gating system comprises a plurality of gate channels configured to connect the circulation duct with the mold cavity.

3. The casting device as recited in claim 2, wherein the gating system further comprises a casting valve configured to separate the metal melt in the circulation duct from a part of the metal melt solidifying in the mold cavity.

4. The casting device as recited in claim 1, wherein the circulation duct is heated at least in sections, the heating being provided by at least one of a hot cell and an external heat supply.

5. The casting device as recited in claim 1, wherein the circulation duct comprises an air release valve.

6. The casting device as recited in claim 1, further comprising a pumping device arranged on each of the at least two circulation duct connections, the pumping device being configured to convey the metal melt into or out of the circulation duct.

7. The casting device as recited in claim 1, wherein the casting chamber is arranged at a lowest point of the circulation duct.

8. The casting device as recited in claim 1, further comprising a pumping device arranged in the circulation duct, the pumping device being configured to provide a circulation of the metal melt in the circulation duct.

9. A refillable casting device comprising:
a mold cavity configured to form a hollow space for a cast part;
a casting chamber for a metal melt;
a plunger configured to pressurize the casting chamber;
a gating system; and
a circulation duct for the metal melt, the circulation duct comprising,
a first connecting duct,
a second connecting duct,
at least two circulation duct connections configured to connect the casting chamber to the first connecting duct and to the second connecting duct,
wherein, the first connecting duct and the second connecting duct are connected to each other in an area of the casting device which faces away from the casting chamber, the circulation duct is configured to be connectable with the mold cavity via the gating system, and the circulation duct is configured so that, during a casting and between casting processes, a melt can circulate in the circulation duct.

10. The casting device as recited in 9, wherein the gating system comprises a plurality of gate channels configured to connect the circulation duct with the mold cavity.

11. The casting device as recited in claim 10, wherein the gating system further comprises a casting valve configured to separate the metal melt in the circulation duct from a part of the metal melt solidifying in the mold cavity.

12. The casting device as recited in claim 9, wherein the circulation duct is heated at least in sections, the heating being provided by at least one of a hot cell and an external heat supply.

13. The casting device as recited in claim 9, wherein the circulation duct comprises an air release valve.

14. The casting device as recited in claim 9, further comprising a pumping device arranged on each of the at least two circulation duct connections, the pumping device being configured to convey the metal melt into or out of the circulation duct.

15. The casting device as recited in claim 9, wherein the casting chamber is arranged at a lowest point of the circulation duct.

* * * * *